US009850869B2

(12) United States Patent
Raney et al.

(10) Patent No.: US 9,850,869 B2
(45) Date of Patent: Dec. 26, 2017

(54) FUEL INJECTOR

(71) Applicant: DELPHI TECHNOLOGIES, INC., Troy, MI (US)

(72) Inventors: Michael R. Raney, Mendon, NY (US); Daniel L. Varble, Henrietta, NY (US); Axel H. Berndorfer, Nittel (DE); Stephan Breuer, Bertrange (LU); James Zizelman, Rochester Hills, MI (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 699 days.

(21) Appl. No.: 13/947,226

(22) Filed: Jul. 22, 2013

(65) Prior Publication Data

US 2015/0021416 A1 Jan. 22, 2015

(51) Int. Cl.
*F02M 61/18* (2006.01)

(52) U.S. Cl.
CPC ..... *F02M 61/1806* (2013.01); *F02M 61/184* (2013.01); *F02M 61/1833* (2013.01); *F02M 61/1846* (2013.01); *F02M 61/186* (2013.01); *F02M 61/188* (2013.01); *F02M 61/1813* (2013.01); *F02M 61/1853* (2013.01); *F02M 61/1866* (2013.01); *F02M 61/1873* (2013.01); *F02M 61/1886* (2013.01)

(58) Field of Classification Search
CPC ..... F02M 61/1853; F02M 61/1866; F02M 61/1873; F02M 61/1886; F02M 61/188; F02M 61/1813; F02M 61/1806; F02M 61/1846; F02M 61/186; F02M 61/184; B05B 1/048; B05B 1/042
USPC ..... 239/533.12, 533.2, 556–560, 552; 123/299, 533.3
See application file for complete search history.

(56) References Cited

U.S. PATENT DOCUMENTS 4,057,190 A 11/1977 Kiwior et al.
4,067,190 A * 1/1978 Hamm ..... F23R 3/40 431/170
RE33,841 E * 3/1992 Rush ..... F02M 51/0671 239/543

(Continued)

FOREIGN PATENT DOCUMENTS

DE 2012112205 A1 6/2013
EP 0611886 A1 8/1994

(Continued)

OTHER PUBLICATIONS

EP Search Report.

*Primary Examiner* — Arthur O Hall
*Assistant Examiner* — Joseph A Greenlund
(74) *Attorney, Agent, or Firm* — Joshua M. Haines

(57) ABSTRACT

A fuel injector for supplying fuel to a fuel consuming devise includes a fuel inlet for receiving the fuel, a nozzle tip for dispensing the fuel from the fuel injector, a conduit for communicating the fuel from the fuel inlet to the nozzle tip, a valve seat, and a valve selectively seatable and unseatable with the valve seat for selectively preventing and permitting fuel flow out of the nozzle tip. The nozzle tip includes a non-circular recess on a downstream side thereof and a metering hole on an upstream side thereof opening into the non-circular recess to allow fuel to exit the nozzle tip, the metering hole having a smaller area than the non-circular recess.

17 Claims, 7 Drawing Sheets

(56) References Cited

U.S. PATENT DOCUMENTS 5,383,597 A * 1/1995 Sooriakumar ..... B05B 1/34 239/5
5,765,750 A * 6/1998 Pace ..... F02M 61/1853 239/5
6,050,507 A * 4/2000 Holzgrefe ..... F02M 51/0671 239/585.1
6,089,476 A * 7/2000 Sugimoto ..... F02M 61/1806 239/533.12
6,135,360 A * 10/2000 Ren ..... F02M 51/005 239/136
6,155,499 A * 12/2000 Rembold ..... B23H 9/00 239/453
6,161,780 A * 12/2000 Sugimoto ..... F02M 61/1806 239/533.12
6,422,481 B2 * 7/2002 Ren ..... F02M 53/06 239/13
6,626,381 B2 * 9/2003 Parrish ..... F02B 61/045 239/533.12
6,669,116 B2 * 12/2003 Iwase ..... F02M 51/0671 239/533.12
6,729,563 B2 * 5/2004 Peterson, Jr. ..... F02M 61/1853 239/533.12
6,783,085 B2 * 8/2004 Xu ..... F02M 61/162 239/463
6,826,833 B1 * 12/2004 Maier ..... B23P 15/16 239/463
7,007,476 B2 * 3/2006 Mains ..... F23N 1/002 60/734
7,093,776 B2 * 8/2006 Schneider ..... F02M 61/186 239/494
7,124,963 B2 * 10/2006 Goenka ..... B05B 1/14 239/504
7,191,961 B2 * 3/2007 Okamoto ..... F02M 51/0671 239/533.1
7,252,249 B2 8/2007 Molnar
7,306,173 B2 * 12/2007 Pilgram ..... F02M 51/0664 239/288
7,597,084 B2 * 10/2009 Vachon ..... F02B 3/06 123/294
7,669,789 B2 * 3/2010 Hung ..... F02M 61/1813 239/533.12
7,677,478 B2 * 3/2010 Maier ..... F02M 51/0671 239/533.12
8,016,214 B2 * 9/2011 Higuma ..... B21K 1/20 239/533.12
8,191,800 B2 * 6/2012 Kitagawa ..... F02M 51/061 239/533.12
8,231,069 B2 * 7/2012 Matsumura ..... F02M 61/1853 239/518
8,328,121 B2 * 12/2012 Irino ..... F02M 61/1806 239/533.12
8,464,539 B2 * 6/2013 Pelletier ..... B05B 1/3436 239/424.5
8,549,862 B2 * 10/2013 Kendrick ..... F02C 7/22 60/733
8,657,213 B2 * 2/2014 Sakata ..... F02M 61/1853 239/533.12
8,672,239 B2 * 3/2014 Ogura ..... F02M 51/0685 239/533.12
8,888,024 B2 * 11/2014 Hashii ..... F02M 51/0682 239/490
9,151,259 B2 * 10/2015 Mosser ..... F02M 61/1833
2006/0192036 A1 * 8/2006 Joseph ..... F02M 61/182 239/596
2009/0025680 A1 * 1/2009 Kihara ..... F02B 23/104 123/299
2009/0200403 A1 * 8/2009 Hung ..... F02M 61/1806 239/533.12
2011/0163189 A1 7/2011 Mancini et al.
2012/0152202 A1 * 6/2012 Kurokawa ..... F02M 61/186 123/298
2013/0255640 A1 * 10/2013 Okamoto ..... F02M 69/04 123/478
2014/0084085 A1 * 3/2014 Hongo ..... F02M 69/047 239/463
2014/0175195 A1 * 6/2014 Vorbach ..... F02M 61/1853 239/585.4
2016/0195052 A1 * 7/2016 Kaneta ..... F02M 61/1833 123/299

FOREIGN PATENT DOCUMENTS

EP 2390491 A1 11/2011
EP 2711536 A1 3/2014
FR 2860557 B1 10/2003
FR 2860558 B1 10/2003
FR 2860557 A1 * 4/2005 ..... F02M 61/182
JP S56157372 11/1981
JP S6487869 3/1989
JP 05272432 10/1993
JP 2007138779 6/2007

* cited by examiner

FUEL INJECTOR

TECHNICAL FIELD OF INVENTION

The present invention relates to fuel injectors for supplying fuel to a fuel consuming device; more particularly to such fuel injectors for direct injection of fuel into a combustion chamber of an internal combustion engine, and even more particularly to such fuel injectors with an inward opening valve and a nozzle tip arranged to generate a plume of fuel with a recirculation zone conducive of combustion by a spark plug.

BACKGROUND OF INVENTION

Modern internal combustion engines typically utilize one or more fuel injectors for metering a precise quantity of fuel to be combusted in respective combustion chambers such that the combustion is initiated with a spark from a spark plug. Combustion of the fuel may be used, for example, to propel a motor vehicle and to generated electricity or drive other accessories in support of operation of the motor vehicle. Fuels in liquid form that are commonly used to power the internal combustion engine include gasoline, alcohol, ethanol, and the like, and blends thereof. Until more recently, fuel injectors commonly referred to as port fuel injectors were predominantly used. Port fuel injectors inject fuel into a port of an intake manifold where the fuel is mixed with air prior to being drawn into the combustion chamber of the internal combustion through an intake valve of the cylinder head. A typical port fuel injector is show in U.S. Pat. No. 7,252,249 to Molnar. The port fuel injector of U.S. Pat. No. 7,252,249; which is typical of port fuel injectors; uses an inward opening valve arrangement which is operated by a solenoid actuator. Fuel that flows past the valve arrangement is metered and shaped by a director plate with holes that are sized and shaped to allow a precise amount of fuel therethrough in such a way as to disperse the fuel into fine droplets which mix with the air.

In order to increase fuel economy and reduce undesirable emissions produced by combustion of the fuel, direct injection fuel injectors have been increasing in use. As the name suggests, direct injection fuel injectors inject fuel directly into the combustion chamber. Direct fuel injectors are commonly available with inwardly opening valve arrangements or outwardly opening valve arrangements. Outwardly opening valve arrangements are desirable due to the hollow cone spray structure that is produced which may include a circumferentially located recirculation zone on the outer perimeter of the hollow cone spray structure which provides a stable site for ignition of the fuel by a spark plug. However, the fuel delivered by outwardly opening direct injection fuel injectors is metered by the distance the valve member is moved from the corresponding valve seat rather than by holes of a director plate. Outwardly opening direct injection fuel injectors have typically required the use of piezoelectric actuators for fast and precise valve actuation which is necessary to precisely meter the fuel and to generate the hollow cone spray structure. While piezoelectric actuators may be effective, they are costly to implement. Advancements in solenoid technology have allowed implementation of solenoid actuators in outwardly opening direct injection fuel injectors; an example of which is shown in United States Patent Application Publication No. US 2011/0163189 A1 to Mancini et al. Even though a solenoid actuator is used, which is less costly than a piezoelectric actuator, the valve components must be made with a high degree of precision which adds to manufacturing costs and complexity. U.S. Pat. No. 8,543,951 to Mieney et al. shows an inwardly opening direct injection fuel injector which includes a nozzle tip with individual holes which are sized and shaped to allow a precise amount of fuel therethrough. Since the fuel is metered by the holes in the nozzle tip, the valve components may be made with a lesser degree of precision than the outwardly opening arrangement. However, the individual holes in the nozzle tip do not allow a beneficial hollow cone spray structure to be produced as is produced by outwardly opening direct injection fuel injectors.

What is needed is an inward opening direct injection fuel injector which minimizes or eliminates one or more of the shortcomings set forth above.

SUMMARY OF THE INVENTION

Briefly described, a fuel injector is provided for supplying fuel to a fuel consuming devise. The fuel injector includes a fuel inlet for receiving the fuel, a nozzle tip for dispensing the fuel from the fuel injector, a conduit for communicating the fuel from the fuel inlet to the nozzle tip, a valve seat, and a valve member selectively seatable and unseatable with the valve seat for selectively preventing and permitting fuel flow out of the nozzle tip. The nozzle tip comprises a non-circular recess on a downstream side thereof and a metering hole on an upstream side thereof opening into the non-circular recess to allow fuel to exit the nozzle tip, the metering hole having a smaller area than the non-circular recess.

BRIEF DESCRIPTION OF DRAWINGS

This invention will be further described with reference to the accompanying drawings in which.

DETAILED DESCRIPTION OF INVENTION

Figure 1:
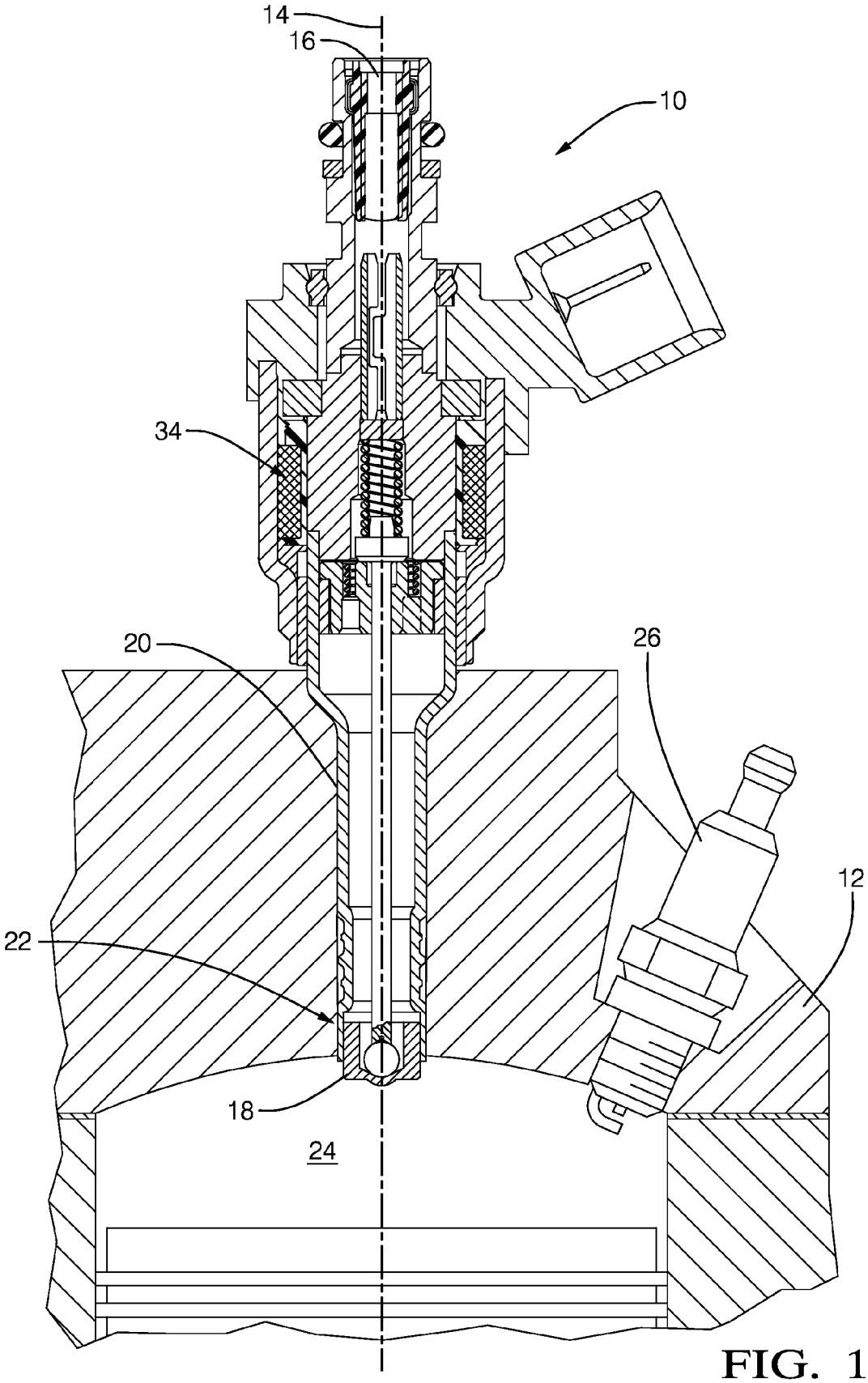
FIG. 1 is a cross-sectional view of a fuel injector in accordance with the present invention.

In accordance with a preferred embodiment of this invention and referring to FIG. 1, a fuel injector 10 is shown for supplying fuel to a fuel consuming device which is illustrated as an internal combustion engine 12. Fuel injector 10 extends along a fuel injector axis 14 and includes a fuel inlet 16 for receiving fuel, a nozzle tip 18 for dispensing fuel from fuel injector 10, a conduit 20 for communicating fuel from fuel inlet 16 to nozzle tip 18, and a valve assembly 22 for selectively preventing and permitting fuel from exiting nozzle tip 18. Nozzle tip 18 may be disposed within a combustion chamber 24 of internal combustion engine 12 for injection of fuel directly within combustion chamber 24 where the fuel is ignited, for example, by a spark plug 26. It should be noted that the location of fuel injector 10 and spark plug 26 relative to combustion chamber 24 as shown in the figures is for illustrative purposes only and the location of fuel injector 10 and/or spark plug 26 relative to combustion chamber 24 may be vary according to engine design.

Figure 2:
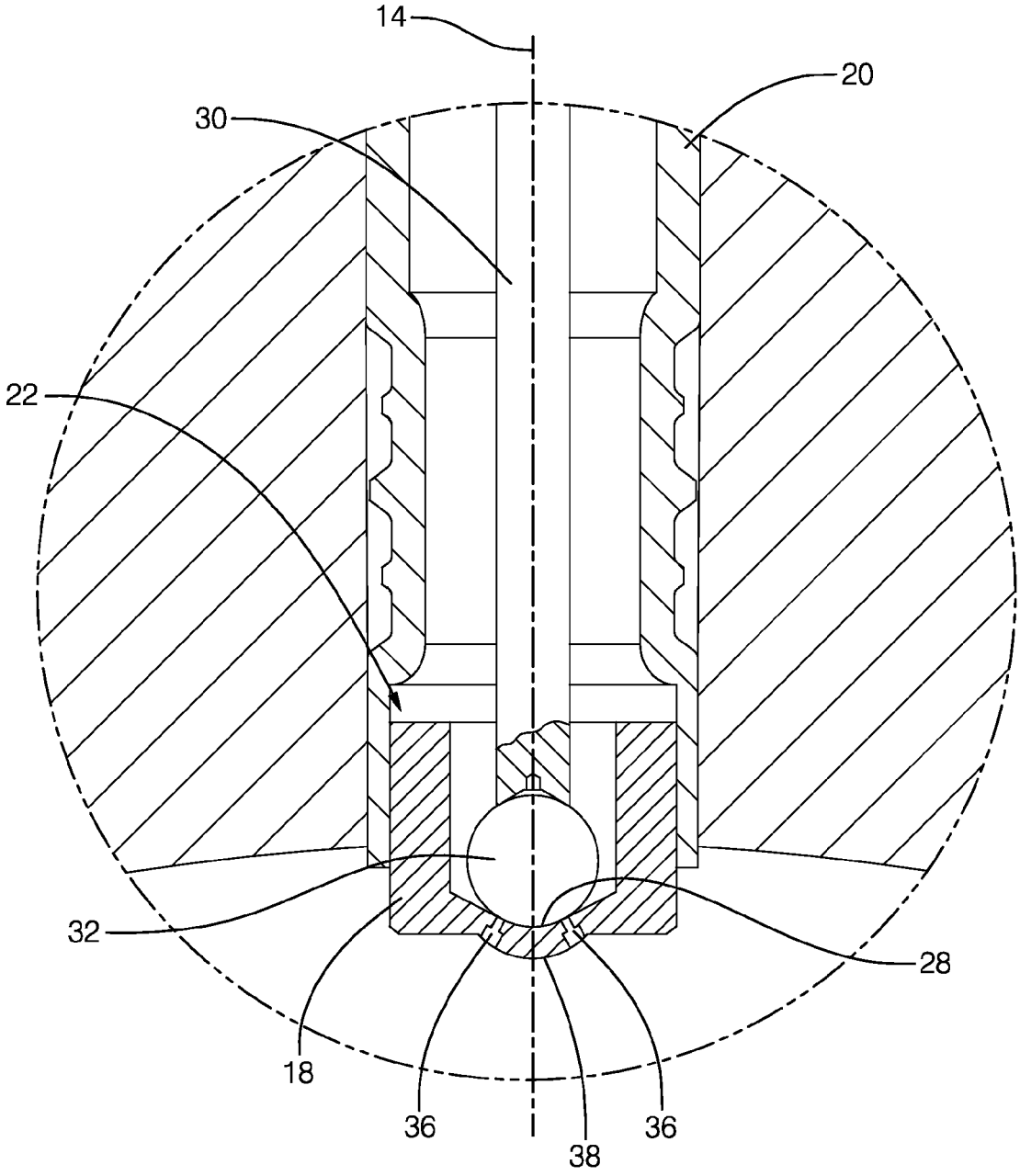
FIG. 2 is an enlargement of a portion of FIG. 1.

With continued reference to FIG. 1 and with additional reference to FIG. 2 which is an enlarged view of a portion of FIG. 1, valve assembly 22 includes a valve seat 28 formed within nozzle tip 18 which is substantially cup-shaped. Valve seat 28 is centered about fuel injector axis 14. Valve assembly 22 also includes a pintle 30 which is coaxial with valve seat 28 and which defines a valve member 32 at one end of pintle 30. Pintle 30, and consequently valve member 32, is reciprocated alone fuel injector axis 14 within conduit 20 by an actuator which is illustrated as solenoid 34. Reciprocation of pintle 30 causes valve member 32 to selectively seat and unseat with valve seat 28 for selectively preventing and permitting fuel flow out of nozzle tip 18. Actuators for reciprocating a pintle in a fuel injector are well known to those skilled in the art of fuel injectors, consequently, solenoid 34 will not be discussed further herein.

Nozzle tip 18 includes one or more nozzle holes 36 extending therethrough to allow fuel that passes by valve seat 28 when valve member 32 is not seated with valve seat 28 to exit nozzle tip 18. Nozzle holes 36 may extend through a nozzle tip surface 38 which is not perpendicular to fuel injector axis 14. Nozzle tip surface 38 is on the exterior of nozzle tip 18 and may be substantially dome-shaped or a portion of a sphere as shown. The Inventors have discovered configurations of nozzle holes 36 which produce spray plumes that are beneficial to combustion of the fuel within combustion chamber 24 as will be described by exemplary embodiments in the paragraphs that follow.

Figure 3A:
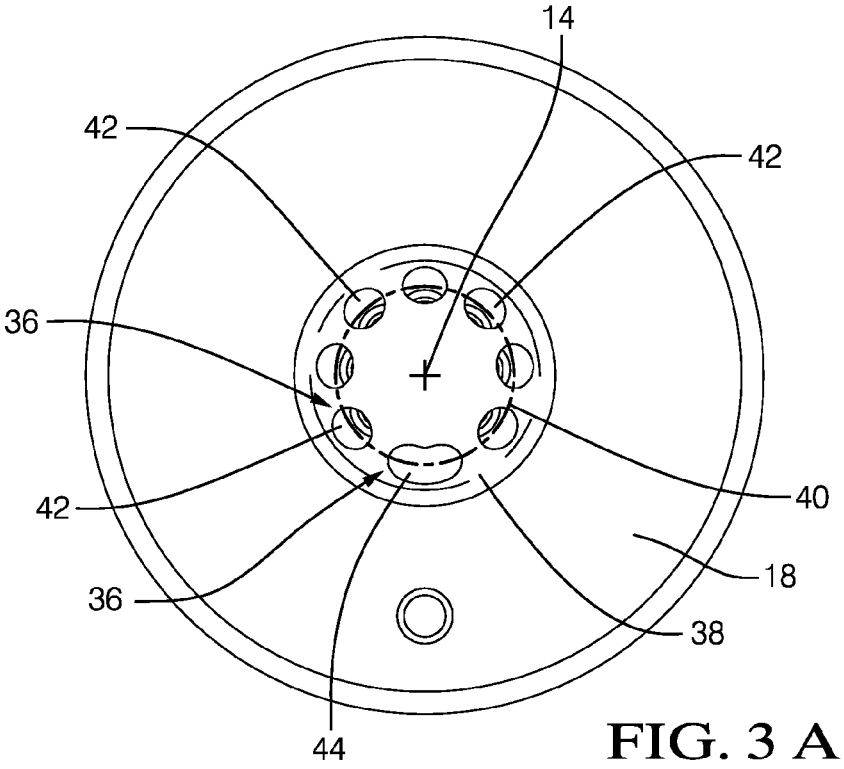
FIG. 3A is an axial end view of a nozzle tip of the fuel injector of FIG. 1 in accordance with the present invention.
Figure 3B:
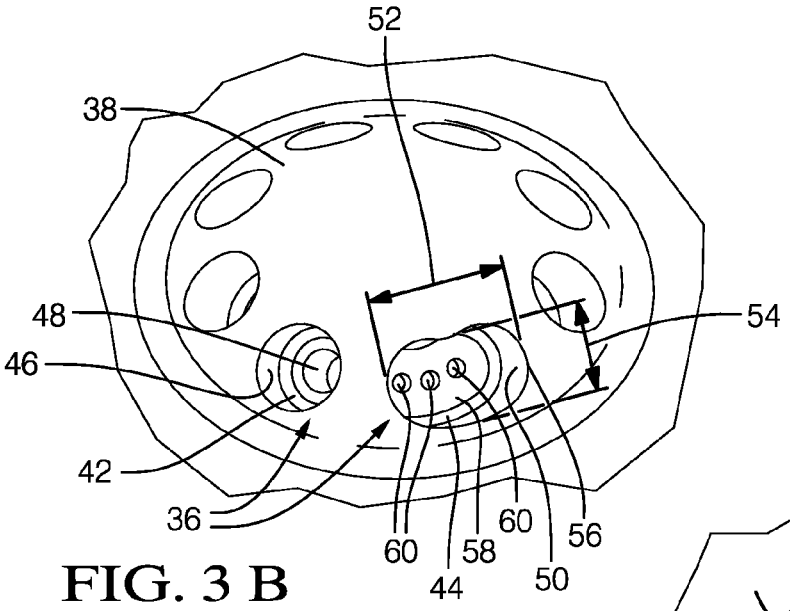
FIG. 3B is an isometric view of a portion of the nozzle tip of FIG. 3A.
Figure 3C:
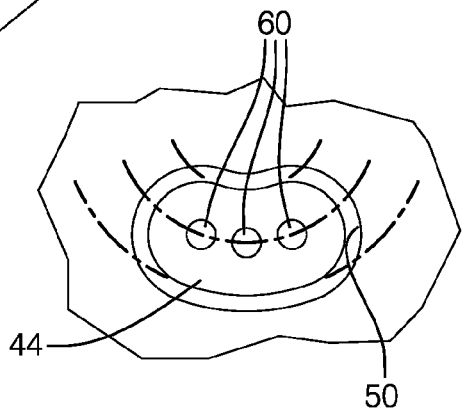
FIG. 3C is a straight-on view of a portion of FIG. 3B.

Reference will now be made to FIG. 3A which shows an axial view of nozzle tip 18, FIG. 3B which shows an isometric view of a portion of nozzle tip 18, and FIG. 3C which shows a straight-on view of a portion of FIG. 3B. As shown, nozzle holes 36 are centered on a circular centerline 40 which is centered about fuel injector axis 14. Nozzle holes 36 comprise a plurality of main nozzle holes 42 (for clarity, only select main nozzle holes 42 have been labeled) and a recirculation generating nozzle hole 44. Main nozzle holes 42 may be spaced substantially equally, i.e. the angular spacing between adjacent main nozzle holes 42 is substantially the same for each main nozzle hole 42. Each one of the plurality of main nozzle holes 42 may be substantially identical, consequently, the subsequent description will refer to one main nozzle hole 42. Main nozzle hole 42 comprises a circular main nozzle hole recess 46 formed in nozzle tip surface 38 such that main nozzle hole recess 46 is centered on circular centerline 40. Nozzle tip surface 38 is on the downstream side of nozzle tip 18. Main nozzle hole 42 also comprises a circular main nozzle metering hole 48 that extends through nozzle tip 18 and opens into main nozzle hole recess 46 such that main nozzle metering hole 48 is centered on circular centerline 40. Main nozzle hole 42 has a smaller area than main nozzle hole recess 46. Main nozzle metering hole 48 is sized to provide a desired flow of fuel from main nozzle hole 42 when valve member 32 is unseat with valve seat 28.

Recirculation generating nozzle hole 44 comprises a non-circular recirculation generating nozzle hole recess 50 formed in nozzle tip surface 38. Recirculation generating nozzle hole recess 50 may be arc-shaped as shown such that recirculation generating nozzle hole recess 50 is centered on circular centerline 40 and has a recess length 52 along circular centerline 40 that is greater than a recess width 54 across circular centerline 40. Recirculation generating nozzle hole recess 50 extends from a top 56 that is proximate to nozzle tip surface 38 to a bottom 58 that is distal from nozzle tip surface 38. Recirculation generating nozzle hole recess 50 may be substantially consistent in size from bottom 58 to top 56. Alternatively, recirculation generating nozzle hole recess 50 may diverge or flare outward from bottom 58 to top 56. As shown, each end of recirculation generating nozzle hole recess 50 may terminate in a radius. Recirculation generating nozzle hole 44 also comprises a plurality of circular recirculation generating metering holes 60 that extend through nozzle tip 18 and open into recirculation generating nozzle hole recess 50 such that recirculation generating metering holes 60 are centered on circular centerline 40 and such that the spacing between adjacent recirculation generating metering holes 60 is the same for each recirculation generating metering hole 60. While three recirculation generating metering holes 60 are shown, it should be understood that a lesser or greater number may be provided. Recirculation generating metering holes 60 are sized to provide a desired flow of fuel from recirculation generating nozzle hole 44 when valve member 32 is unseat with valve seat 28 and may be sized to be smaller in diameter than main nozzle metering hole 48. Recirculation generating metering holes 60 together have a smaller area than recirculation generating nozzle hole recess 50. Fuel exiting recirculation generating metering holes 60 is shaped and dynamically affected by recirculation generating nozzle hole recess 50 to produces a plume of fuel with a recirculation zone conducive of combustion by spark plug 26. Fuel injector 10 may be oriented within combustion chamber 24 such that spark plug 26 is located within the recirculation zone generated by recirculation generating nozzle hole 44.

Figure 4A:
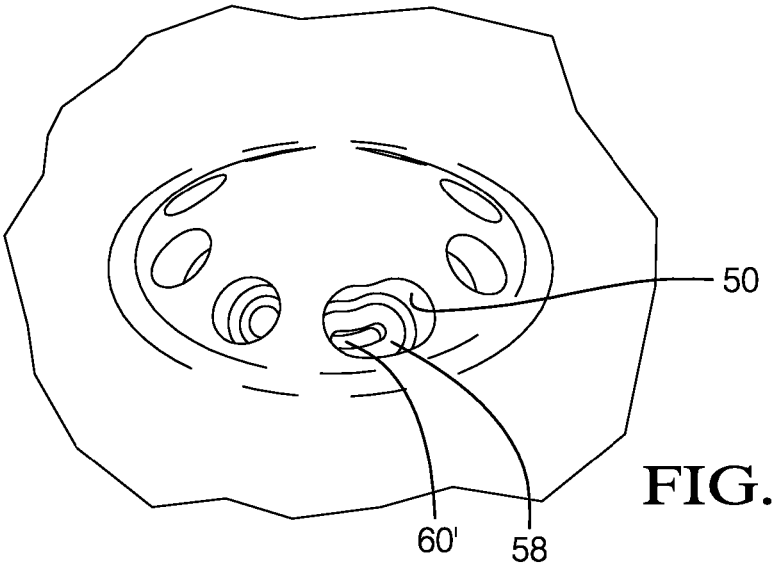
FIG. 4A is a variant of FIG. 3B.
Figure 4B:
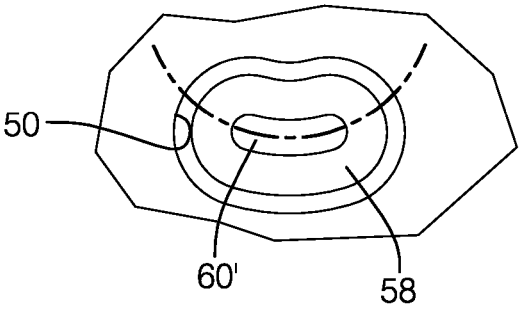
FIG. 4B is a straight-on view of a portion of FIG. 4A.

Alternatively, as shown in FIGS. 4A and 4B, recirculation generating metering holes 60 may be substituted with a single non-circular recirculation generating metering hole 60'. As shown, recirculation generating metering hole 60' is arc-shaped such that recirculation generating metering hole 60' is centered on circular centerline 40. The perimeter of recirculation generating metering hole 60' may be offset from the perimeter of bottom 58 a consistent distance, i.e. the perpendicular distance from any point on the perimeter of recirculation generating metering hole 60' outward to the outer perimeter of bottom 58 is the same as the perpendicular distance from any other point on the perimeter of recirculation generating metering hole 60' outward to the outer perimeter of bottom 58. Fuel exiting recirculation generating metering hole 60' is shaped and dynamically affected by recirculation generating nozzle hole recess 50 to produces a plume of fuel with a recirculation zone conducive of combustion by spark plug 26.

Figure 5:
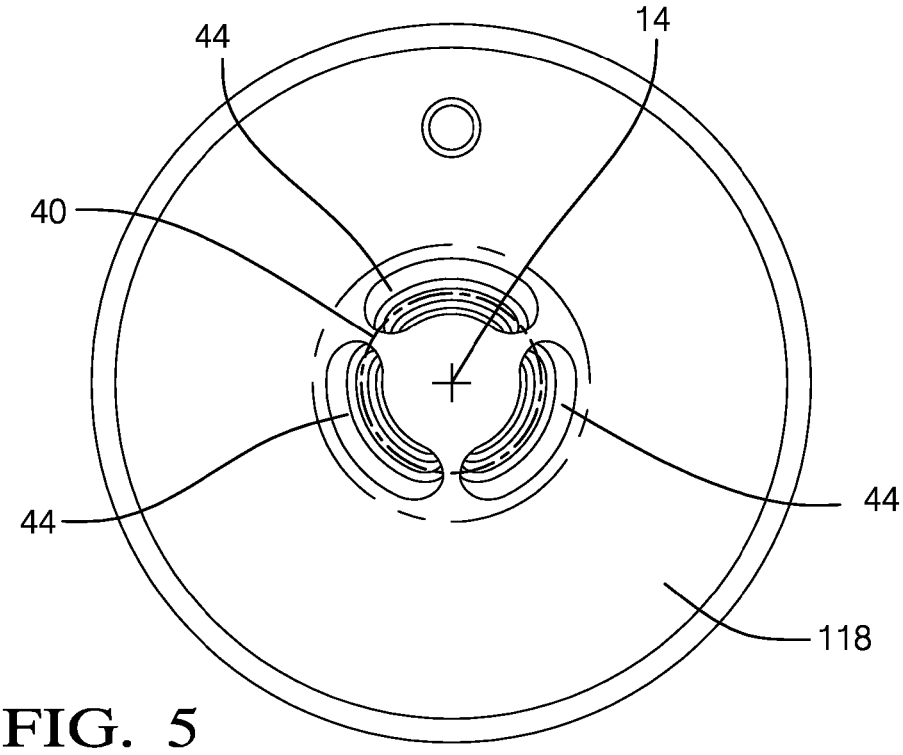
FIG. 5 is an axial end view of another nozzle tip in accordance with the present invention.

Reference will now be made to FIG. 5 which shows a second embodiment of a nozzle tip 118. Nozzle tip 118 is substantially the same as nozzle tip 18 described with reference to FIGS. 3A, 3B, and 3C except that main nozzle holes 42 are substituted with a plurality of recirculation generating nozzle holes 44. Each recirculation generating nozzle hole 44 may be spaced substantially equally, i.e. the angular spacing between adjacent recirculation generating nozzle holes 44 is substantially the same for each recirculation generating nozzle hole 44. Recirculation generating nozzle holes 44 may include a plurality of recirculation generating metering holes 60 as described previously with reference to FIG. 3B or a recirculation generating metering hole 60' which was describe previously with reference to FIGS. 4A and 4B. Providing a plurality of recirculation generating nozzle holes 44 centered about circular centerline 40 may provide a better distribution of fuel in combustion chamber 24 which may help to minimize wall wetting of combustion chamber 24 and to minimize interaction between the fuel and the intake valves (not shown), exhaust valves (not shown), and spark plug 26. While three recirculation generating nozzle holes 44 are shown, it should be understood that a lesser or greater number may be provided.

Figure 6:
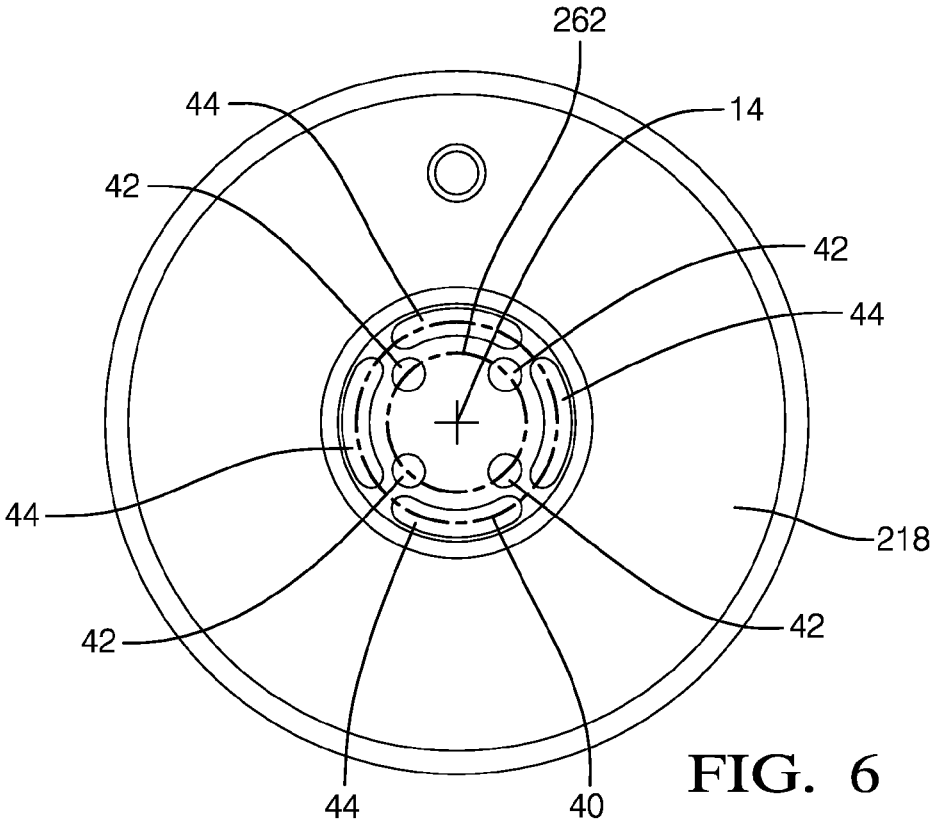
FIG. 6 is an axial end view of another nozzle tip in accordance with the present invention.

Reference will now be made to FIG. 6 which shows a third embodiment of a nozzle tip 218. Nozzle tip 218 is substantially the same as nozzle tip 118 described with reference to FIG. 5 except that nozzle tip 218 includes a plurality of main nozzle holes 42 centered on a circular centerline 262 which is concentric to circular centerline 40. As shown, main nozzle holes 42 are located radially inward from recirculation generating nozzle holes 44; however, this relationship may be reversed such that main nozzle holes 42 are located radially outward from recirculation generating nozzle holes 44. Also as shown, each main nozzle hole 42 may be positioned to be radially aligned with the space between adjacent recirculation generating nozzle holes 44. The spray plumes produced by main nozzle holes 42 help to cover the gaps between the plumes produced by recirculation generating nozzle holes 44, thereby better approximating the hollow cone spray structure that is produced by outwardly opening direct injection fuel injectors.

Figure 7:
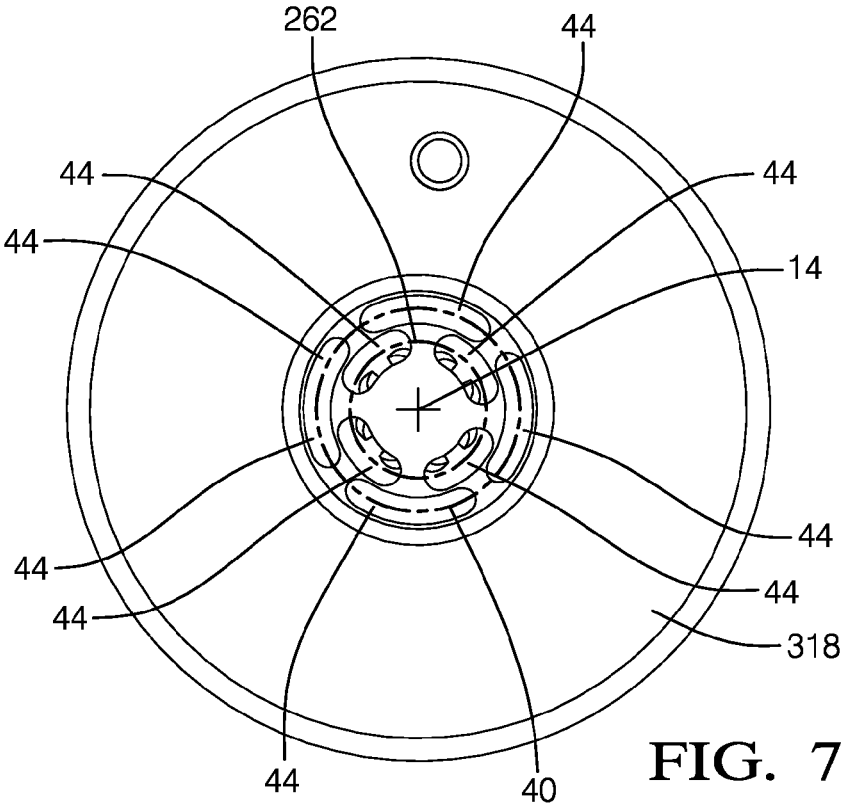
FIG. 7 is an axial end view of another nozzle tip in accordance with the present invention.

Reference will now be made to FIG. 7 which shows a fourth embodiment of a nozzle tip 318. Nozzle tip 318 is substantially the same as nozzle tip 218 except that nozzle tip 318 includes a plurality of recirculation generating nozzle holes 44 centered on circular centerline 262. As shown, circular centerline 262 is located radially inward from circular centerline 40; however, this relationship may be reversed such that circular centerline 40 is located radially outward from circular centerline 262. Also as shown, each recirculation generating nozzle hole 44 that is located on circular centerline 262 may be positioned to be radially aligned with the space between adjacent recirculation generating nozzle holes 44 that are located on circular centerline 40. The spray plumes produced by recirculation generating nozzle holes 44 centered on circular centerline 262 help to cover the gaps between the plumes produced by recirculation generating nozzle holes 44 centered on circular centerline 40, thereby better approximating the hollow cone spray structure that is produced by outwardly opening direct injection fuel injectors.

Figure 8:
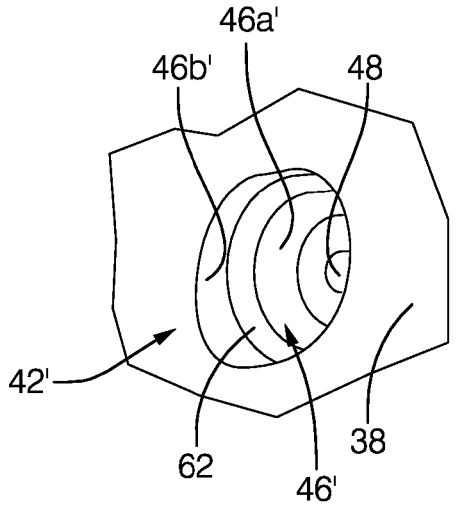
FIG. 8 is an enlargement of a nozzle hole of the nozzle tip in accordance with the present invention.

Reference will now be made to FIG. 8 which shows a main nozzle hole 42' which may be used as an alternative to main nozzle hole 42. Main nozzle hole 42' differs from main nozzle hole 42 in that main nozzle hole 42 includes a main nozzle hole recess 46' in nozzle tip surface 38 such that main nozzle hole recess 46' is stepped, thereby defining a lower main nozzle hole recess 46*a'* and an upper main nozzle hole recess 46*b'*. Lower main nozzle hole recess 46*a'* and upper main nozzle hole recess 46*b'* are separated by a shoulder 62. Main nozzle hole 42' also includes main nozzle metering hole 48 just as main nozzle hole 42 does. The stepped nature of main nozzle hole 42' may be helpful in breaking up and dispersing fuel.

Figure 9:
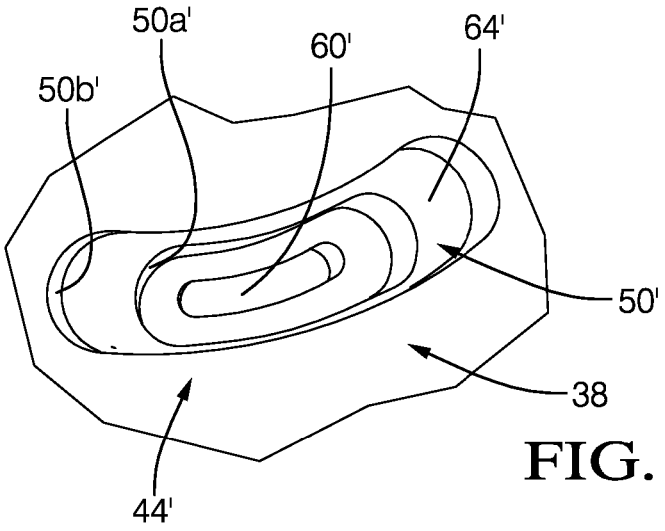
FIG. 9 is an enlargement of another nozzle hole.

Reference will now be made to FIG. 9 which shows a recirculation generating nozzle hole 44' which may be used as an alternative to recirculation generating nozzle hole 44. Recirculation generating nozzle hole 44' differs from recirculation generating nozzle hole 44 in that recirculation generating nozzle hole 44' includes a recirculation generating nozzle hole recess 50' in nozzle tip surface 38 such that recirculation generating nozzle hole recess 50' is stepped, thereby defining a lower recirculation generating nozzle hole recess 50*a'* and an upper recirculation generating nozzle hole recess 50*b'*. Lower recirculation generating nozzle hole recess 50*a'* and upper recirculation generating nozzle hole recess 50*b'* are separated by a shoulder 64' which surrounds the entire perimeter of lower recirculation generating nozzle hole recess 50*a'* and upper recirculation generating nozzle hole recess 50*b'*. Recirculation generating nozzle hole 44' also includes recirculation generating metering hole 60', or alternatively, recirculation generating metering hole 60, just as recirculation generating nozzle hole 44 does. The stepped nature of recirculation generating nozzle hole 44' may further help to shape and dynamically affect the fuel to produce a plume of fuel with a recirculation zone conducive of combustion by spark plug 26.

Figure 10:
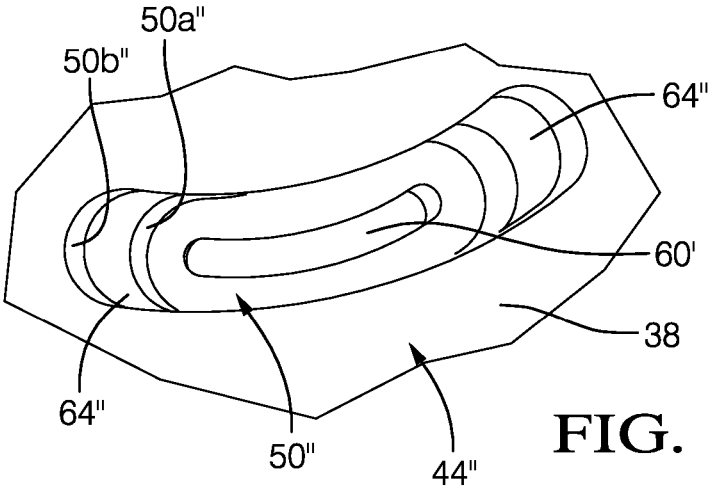
FIG. 10 is an enlargement of another nozzle hole.

Reference will now be made to FIG. 10 which shows a recirculation generating nozzle hole 44" which may be used as an alternative to recirculation generating nozzle hole 44 or recirculation generating nozzle hole 44'. Recirculation generating nozzle hole 44" differs from recirculation generating nozzle hole 44' in that recirculation generating nozzle hole 44" includes a recirculation generating nozzle hole recess 50" in nozzle tip surface 38 such that recirculation generating nozzle hole recess 50" is stepped, thereby defining a lower recirculation generating nozzle hole recess 50*a"* and an upper recirculation generating nozzle hole recess 50*b"*. Lower recirculation generating nozzle hole recess 50*a"* and upper recirculation generating nozzle hole recess 50*b"* are separated by a shoulder 64" only at each end of lower recirculation generating nozzle hole recess 50*a"* and upper recirculation generating nozzle hole recess 50*b"* with no shoulder therebetween. Recirculation generating nozzle hole 44" also includes recirculation generating metering hole 60', or alternatively, recirculation generating metering hole 60, just as recirculation generating nozzle hole 44 does. Including shoulders 64" only at the ends of lower recirculation generating nozzle hole recess 50*a"* and upper recirculation generating nozzle hole recess 50*b"* may allow fuel spray to expand laterally to a greater extend in order to form a more complete curtain of fuel.

Figure 11:
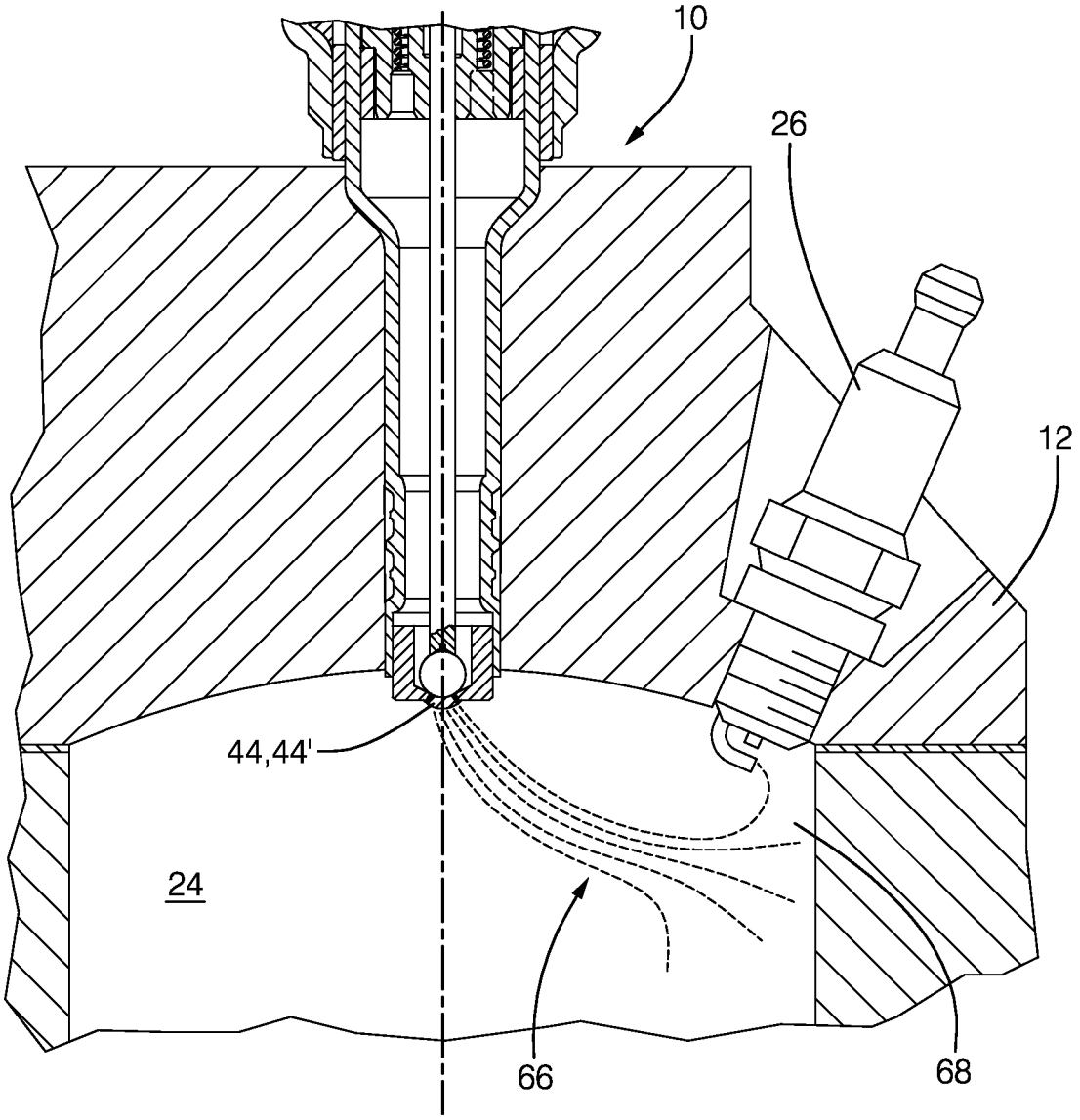
FIG. 11 is a spray plume generated by a recirculation generating nozzle hole of the fuel injector in accordance with the present invention.

Reference will now be made to FIG. 11 which shows a spray plume 66 produced within combustion chamber 24 by a representative recirculation generating nozzle hole 44, 44' of fuel injector 10. As can be seen, the end of spray plume 66 produces a recirculation zone 68 where spray plume 66 wraps around and begins to flow back slightly toward fuel injector 10. Recirculation zone 68 is in close proximity to spark plug 26 and may closely resemble the highly desirable recirculation zone produced in an outward opening direct injection fuel injector. Consequently, recirculation zone 68 provides a stable and robust ignition site for ignition by spark plug 26 and may promote long life of spark plug 26. However, fuel injector 10 may be manufactured more economically since fuel injector 10 is an inward opening direct injection fuel injector.

While fuel injector 10 has been described in terms of use in a spark ignited direct injection arrangement, it should be understood that other uses are contemplated. For example only, fuel injector 10 may be used in a port injection arrangement and may also be used in compression ignition arrangements which may also include using diesel as a fuel.

While this invention has been described in terms of the preferred embodiments thereof, it is not intended to be so limited, but rather only to the extent set forth in the claims that follow.

We claim:

1. A fuel injector for supplying fuel to a fuel consuming device, said fuel injector comprising:

a fuel inlet for receiving fuel;

a nozzle tip for dispensing fuel from said fuel injector;

a conduit for communicating fuel from said fuel inlet to said nozzle tip;

a valve seat; and a valve member selectively seatable and unseatable with said valve seat for selectively preventing and permitting fuel to flow from said fuel inlet out of said nozzle tip;

wherein said nozzle tip comprises a non-circular recess on a downstream side thereof and a plurality of metering holes on an upstream side thereof opening into said non-circular recess to allow fuel to exit said nozzle tip, said plurality of metering holes having a smaller area than said non-circular recess, wherein said non-circular recess in an arc-shaped recess, wherein said nozzle tip further comprises a plurality of circular recesses on said downstream side thereof and a plurality of circular metering holes on an upstream side thereof such that each one of said plurality of circular metering holes opens into a respective one of said plurality of circular recesses to allow fuel to exit said nozzle tip, each one of said plurality of circular metering holes having a smaller area than each one of said plurality of circular recesses; and wherein said valve member reciprocates along a fuel injector axis and said arc-shaped recess is centered on a circular centerline which is centered about said fuel injector axis.

2. A fuel injector as in claim 1 wherein each one of said plurality of circular recesses is centered on said circular centerline.

3. A fuel injector as in claim 1 wherein each one of said plurality of circular recesses are stepped.

4. A fuel injector for supplying fuel to a fuel consuming device, said fuel injector comprising:

a fuel inlet for receiving fuel;

a nozzle tip for dispensing fuel from said fuel injector;

a conduit for communicating fuel from said fuel inlet to said nozzle tip;

a valve seat; and a valve member selectively seatable and unseatable with said valve seat for selectively preventing and permitting fuel to flow from said fuel inlet out of said nozzle tip;

wherein said nozzle tip comprises a non-circular recess on a downstream side thereof and a plurality of metering holes on an upstream side thereof opening into said non-circular recess to allow fuel to exit said nozzle tip, said plurality of metering holes having a smaller area than said non-circular recess; and wherein said non-circular recess is one of a plurality of non-circular recesses and said plurality of metering holes is a first plurality of metering holes and each one of said plurality of non-circular recesses includes a respective plurality of metering holes which opens thereinto to allow fuel to exit said nozzle tip.

5. A fuel injector as in claim 4 wherein each one of said plurality of non-circular recesses is arc-shaped.

6. A fuel injector as in claim 5 wherein said valve member reciprocates along a fuel injector axis and each one of said plurality of non-circular recesses are centered on a circular centerline which is centered about said fuel injector axis.

7. A fuel injector as in claim 6 wherein each one of said plurality of metering holes is centered on said circular centerline.

8. A fuel injector as in claim 5 wherein each one of said plurality of non-circular recesses is stepped.

9. A fuel injector as in claim 6 wherein said plurality of non-circular recesses is a first plurality of non-circular recesses and said circular centerline is a first circular centerline; said nozzle tip further comprising:

a second plurality of recesses on a downstream side thereof and a second plurality of metering holes on an upstream side thereof such that each one of said plurality of metering holes opens into a respective one of said second plurality of recesses to allow fuel to exit said nozzle tip;

wherein each one of said second plurality of recesses are centered on a second circular centerline which is concentric with said first circular centerline.

10. A fuel injector as in claim 9 wherein each one of said second plurality of metering holes is centered on said second circular centerline.

11. A fuel injector as in claim 9 wherein said second circular centerline is radially inward of said first circular centerline.

12. A fuel injector as in claim 9 wherein each one of said second plurality of recesses is radially aligned with a respective space which separates adjacent ones of said first plurality of non-circular recesses.

13. A fuel injector as in claim 9 wherein each one of said second plurality of recesses is arc-shaped.

14. A fuel injector as in claim 9 wherein each one of said second plurality of recesses is circular.

15. A fuel injector as in claim 9 wherein each one of said first plurality of non-circular recesses is stepped.

16. A fuel injector as in claim 9 wherein each one of said second plurality of recesses is stepped.

17. A fuel injector for supplying fuel to a fuel consuming device, said fuel injector comprising:

a fuel inlet for receiving fuel;

a nozzle tip for dispensing fuel from said fuel injector;

a conduit for communicating fuel from said fuel inlet to said nozzle tip;

a valve seat; and a valve member selectively seatable and unseatable with said valve seat for selectively preventing and permitting fuel to flow from said fuel inlet out of said nozzle tip;

wherein said nozzle tip comprises an arc-shaped recess on a downstream side thereof and a metering hole on an upstream side thereof opening into said arc-shaped recess to allow fuel to exit said nozzle tip, said metering hole having a smaller area than said arc-shaped recess;

wherein said arc-shaped recess is one of a plurality of arc-shaped recesses and said metering hole is one a plurality of metering holes such that each one of said plurality of metering holes opens into a respective one of said arc-shaped recess to allow fuel to exit said nozzle tip;

wherein said valve member reciprocates along a fuel injector axis and each one of the plurality of arc-shaped recesses are centered on a circular centerline which is centered about said fuel injector axis and each one of said plurality of metering holes is centered on said circular centerline;

wherein said plurality of arc-shaped recesses is a first plurality of arc-shaped recesses, said plurality of metering holes is a first plurality of metering holes, and said circular centerline is a first circular centerline; said nozzle tip further comprising a second plurality of recesses on a downstream side thereof and a second plurality of metering holes on an upstream side thereof such that each one of said plurality of metering holes opens into a respective one of said second plurality of recesses to allow fuel to exit said nozzle tip; and wherein each one of said second plurality of recesses are centered on a second circular centerline which is concentric with said first circular centerline.

* * * * *